US005647129A

United States Patent [19]

Stamper

[11] Patent Number: 5,647,129

[45] Date of Patent: Jul. 15, 1997

[54] FOLDING KNIFE

[76] Inventor: James D. Stamper, P.O. Box 62, Grantham, N.H. 03753

[21] Appl. No.: 650,022

[22] Filed: May 17, 1996

Related U.S. Application Data

[63] Continuation of Ser. No. 172,831, Dec. 23, 1993, abandoned.

[51] Int. Cl.[6] ..... B26B 1/10

[52] U.S. Cl. ..... 30/139; 30/153; 30/155; 30/158; 30/160; 30/161

[58] Field of Search ..... 30/138, 139, 153, 30/155, 157, 158, 159, 160, 161, 329, 330, 331; 7/120

[56] References Cited

U.S. PATENT DOCUMENTS

| | | | |
|---|---|---|---|
| 249,896 | 11/1881 | Chamberlain . | |
| 273,981 | 3/1883 | Glover | 30/153 X |
| 586,849 | 7/1897 | Ibelli | 30/153 X |
| 594,984 | 12/1897 | Chapman . | |
| 684,016 | 10/1901 | Weidknecht . | |
| 727,724 | 5/1903 | Weil . | |
| 728,416 | 5/1903 | Rowland . | |
| 730,025 | 6/1903 | Kaufman . | |
| 770,118 | 9/1904 | Rowland . | |
| 852,524 | 5/1907 | Sahlstein . | |
| 924,070 | 6/1909 | Holman . | |
| 947,980 | 2/1910 | Romano . | |
| 1,270,927 | 6/1918 | Hanstein . | |
| 2,989,100 | 6/1961 | Burdis et al. | 30/153 X |
| 4,173,068 | 11/1979 | Cargill | 30/161 |
| 4,240,201 | 12/1980 | Sawby et al. | 30/161 |
| 4,563,813 | 1/1986 | Fortenberry | 30/161 |
| 4,606,123 | 8/1986 | Wrench | 30/153 |
| 4,985,998 | 1/1991 | Howard | 30/158 |

FOREIGN PATENT DOCUMENTS

| | | |
|---|---|---|
| 912386 | 8/1946 | France . |
| 1059965 | 3/1994 | France . |
| 1770 | of 1885 | United Kingdom . |
| 3938 | of 1898 | United Kingdom . |

*Primary Examiner*—Rinaldi I. Rada
*Assistant Examiner*—Clark F. Dexter
*Attorney, Agent, or Firm*—Michael J. Weins

[57] ABSTRACT

A tri-fold knife is provided which has a blade having a tang and bifurcated handle. The handle has a main handle which has a forward end which is pivotably attached to the tang. The main handle terminates in a butt end. A tail handle is provided with a forward engaging end and a butt end coupling which pivotably engages the butt end of the main handle. The main handle is provided with a main handle slot and the tail handle is provided with a tail handle slot which connects with the main handle slot. When the main handle forward end engages the tail handle forward engaging end, a knife handle is formed. When the tail handle is end to end with the main handle, the slots form a sheath into which the knife blade can be pivoted. Preferably, locks are provided to hold the blade with respect to the main handle when the knife is opened and the blade is exposed. A lock is also provided to hold the blade in the closed position where the blade lies in the main handle slot and the tail handle slot.

13 Claims, 6 Drawing Sheets

FOLDING KNIFE

This application is a continuation of application Ser. No. 08/172,831 filed Dec. 23, 1993, now abandoned.

FIELD OF THE INVENTION

The present invention relates to a folding knife and more particularly to a tri-fold knife and related convenient release mechanisms that make a knife easier to open and close.

BACKGROUND OF THE INVENTION

Knives which fold into handles are common and known as pocket knives. Pocket knives suffer in varying degrees from three limitations; the length of the blade that can be held in the handle, the appearance of the handle when the blade is extended, and the stability of the blade when it is extended.

U.S. Pat. No. 1,270,727 teaches a pocket knife which effectively stores the blade in the handle; however, it limits the blade length to the length of the handle. The handle is bifurcated, forming two halves, one of which pivots from a closed position where the halves abut and are in a side-by-side relationship forming a handle to a position where the halves meet at a right angle. A spring is provided to urge the handle elements into the side-by-side relationship.

The difficulty relating to the limited length of the blade which can be stored has in part been overcome by U.S. Pat. No. 770,118 where the handle elements are designed to overlap in the closed position. The structure is limited to construction from sheet type material and thus, lacks the strength and integrity which can be obtained from a solid handle.

The problem of the integrity of the handle has in part been overcome by U.S. Pat. No. 728,416 and U.S. Pat. No. 924,070, both of which disclose an internally mounted tail which pivots about a position within the handle thus, decreasing the length of the blade, when compared with the blade of the '118 patent, which can be accommodated. The handle, when closed with the blade extended, does not have the smooth contours possessed by conventional hunting knives. Knives such as those taught by the '416 and '070 patents also have a discontinuity in the handle when the handle is open to store the blade. The '070 patent illustrates the discontinuity in the width that occurs when the blade is stored in the handle.

U.S. Pat. No. 947,980 illustrates a knife where the tail is mounted in the butt end increasing the length of the blade that can be accommodated by the knife handle. However, this knife still results in a discontinuity in the contour of the handle when it is open to store the blade. Furthermore, the design of the '980 patent requires the narrowing of the guard region of the knife which further distinguishes the appearance from conventional hunting knives.

Thus, there is a need for a knife where the handle will accommodate a long blade and yet provide a conventional appearing camping or hunting knife when in the open position.

OBJECTS OF THE INVENTION

It is an object of the invention to provide a folding knife where the length of the blade sheathed by the handle exceeds the handle length when the handle serves as a grip.

It is another object of the invention to provide a knife that can be opened or closed with one hand.

It is yet another object of the invention to provide a folding knife that has the feel, rigidity, and appearance of hunting knife when open.

Still a further object of the invention is to provide a knife that can be readily opened with either the right or left hand.

It is still a further object of the invention to provide a push button operated mechanism for a folding knife which releases and locks its blade with respect to its handle.

Yet a further object of the invention is to provide a lever operating mechanism for releasing a locking blade with respect to a knife handle.

It is another object to provide a self sharpening knife.

It is still a further object of the invention to provide a knife with a bifurcated handle where the sections have a common width.

These and other objects will become apparent from the following description, claims and drawings.

SUMMARY OF THE INVENTION

The present invention provides a folding knife having a handle and a blade which serve as a hunting knife. The handle is bifurcated with each component having a bearing surface such that when the two components of the handle are in a side by side relationship, the bearing surfaces abut, providing a grip for the blade. When the two components of the handle are in an end to end relationship, the sharp edge of the knife folds into the handle which then serves as a sheath for the knife. The present invention provides a handle which will sheath a blade which is longer than the length of the main handle and which, when the handle components are in the side by side relationship, will serve as a knife grip.

The tri-fold knife has three principal parts: a blade, a main handle, and a tail handle. The blade has a cutting edge and terminates in a tang. The main handle forms one of the handle components and has a bearing surface having a width W. The main handle terminates at one end in a forward end, and at the other end in a butt end. A main handle slot having main handle slot sides initiates at the main handle bearing surface and terminates in a main handle slot back. The main handle slot extends through the forward end and the butt end. The tang of the blade mounts in the main handle slot and is pivotably attached to the forward end.

The tail handle has a tail handle bearing surface having the width W. The tail handle terminates in a forward engaging end and a butt end coupling which pivotably engages the butt end of the main handle. The butt end coupling allows the tail handle to rotate from a position where the handle components are in an end to end relationship to a position where the main handle bearing surface abuts the tail handle bearing surface. When the bearing surfaces abut, a knife grip is formed and the main handle and the tail handle are in the closed handle position. The main handle and the tail handle are said to be in the open position when the main handle and the tail handle are in an end to end relationship and serve as a sheath for the blade.

In the closed position, the forward end and the forward engaging end are engaged forming a bifurcated knife handle. Since the main handle bearing surface and the tail handle bearing surface abut and have a common width W, a smooth transition is formed between the main handle and the tail handle.

The tail handle has a tail handle slot having tail handle slot sides initiating at the tail handle bearing surface and terminating in a tail handle slot back. The tail handle slot extends through the forward engaging end and the butt end coupling. The tail handle slot connects with the main handle slot. A butt stop is provided to limit the rotation of the tail handle so that when the main handle and the tail handle are in the open position, the tail handle slot and the main handle slot are positioned such that the main handle slot back and the tail handle slot back are substantially co-planar at their junction. Having the slots so positioned allows the main handle slot, in combination with the tail handle slot, to serve as a sheath for the cutting edge of the blade of the knife. Since the bifurcated handle is constructed such that the main handle and the tail handle abut rather than overlap as taught by patents such as the '118 patent, the main handle slot and the tail handle slot can both have the same width and the slot width can be set such that the blade substantially fills the cross section of the slot.

Since the main handle and the tail handle abut and do not overlap there is no need for a large handle cavity into which the adjoining handle can fit. With only a small cavity in the handle and with the tail handle and main handle having bearing surfaces securing their relative position, the rigidity of the handle can approach that of a solid handle. To further enhance the structural rigidity of the handle, it is preferred that means be provided for locking the forward end with respect to the forward engaging end. In the event that the bearing surfaces are nonplanar, the non-planar character of the surface can provide a locking means.

A preferred means for locking the forward end and the forward engaging end is to provide lugs on the forward end which are substantially normal to the bearing surface. The lugs engage lug recesses in the forward engaging end. The relative position of the lugs and the lug recesses can be reversed.

In one embodiment of the present invention, a standard hunting type blade having the cutting edge which is curved providing a convex cutting edge is employed. When the blade is so contoured, the forward engaging end can be contoured such that the forward engaging end, in combination with the forward end, provides a guard when the knife blade is pivoted away from the main handle slot, and the tail handle slot and the tail handle are pivoted to bring the forward end and the forward engaging end into contact.

In order to avoid accidental opening or closing of the knife, it is preferred that a locking means be provided to maintain the knife in the open and closed position.

In one preferred embodiment, the locking means is provided by employing an open position notch and a closed position notch in the tang of the blade. A locking bar is provided which is pivotably mounted in the main handle slot and forms a portion of the main slot back. A spring is interposed between the locking bar and the main handle. A locking lug is attached to the locking bar and the spring urges the locking lug into the open position notch when the blade is in its opened position and into the closed position notch when the blade is in its closed position where the cutting edge of the blade is sheathed by the main handle slot and the tail handle slot. Means are provided to raise the locking lug from the notches thereby allowing the blade to change position. In one embodiment, a depression in the back of the main handle allows pressure to be applied to compress the spring and pivot the locking bar, raising the locking lug with respect to the notch in which it is engaged. This depression allows pressure to be applied to the locking bar and offers means for raising the locking lug. Alternatively, a button activated means for raising the locking lug such as taught in U.S. Pat. No. 4,240,201 can be employed.

The present invention also includes an improved button activated means for raising the locking lug. The improvement includes employing a rod which passes through the main handle. The rod has a region of reduced cross section into which the locking bar extends. Sloped sidewalls are provided to define the region of reduced cross section. When the rod is pushed from either side of the handle, the sloped sidewalls press against the locking bar and serve as a locking bar raising surface which raises the locking bar.

The opening and closing of the knife of the present invention can be simplified by making the knife a "one handed knife" by providing a means to urge the opening of the blade. The rod used to raise the locking bar can be rendered dual purpose if a second region of reduced cross section is provided and the tang of the blade is designed such that it will extend into the second reduced region. Again, the sidewalls are sloped such that when the rod is pushed from either direction, the tang and the locking bar will be raised.

In a still further preferred embodiment for "a one handed knife", a lever activated mechanism is employed to assist in opening and closing the knife. In this preferred embodiment, again, a rod passes through the main handle and serves as a means for raising the locking bar and urging the blade to open. The rod has a locking bar raising surface which engages the locking bar and a tang raising surface which engages the tang of the blade. The raising surfaces are so shaped that as the rod is turned, the raising surfaces will raise the locking bar and the knife blade. A lever is provided which attaches to the rod and can be raised and lowered by pivoting about the axis of the rod providing a mechanical advantage to assist in turning the rod.

To further assist in the closing of the knife, it is preferred that the lever be provided with a lever leg coupled to it and positioned to engage the tail handle when the tail handle abuts the main handle. As the lever is moved, the lever leg will engage the tail handle to separate it from the main handle.

To further assist the opening of the blade from the closed position in the handle and the closing of the blade into the handle, it is preferred that a shaft pass through the forward engaging end and that a guide wheel be mounted on the shaft. The wheel, preferably, has a circumferential groove for accommodating the cutting edge of the blade of the knife.

BEST MODE OF CARRYING THE INVENTION INTO PRACTICE

Figure 1:
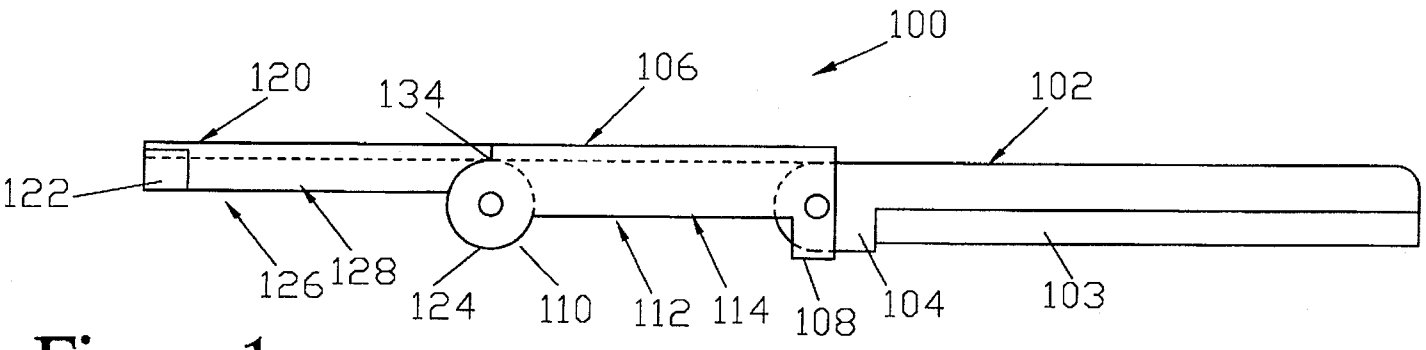
FIG. 1 is one embodiment of the present invention for a tri-fold camp knife. The knife has a blade pivotably attached to a main handle. The main handle is, in turn, pivotably attached to a tail handle. As illustrated, the blade, the main handle, and the tail handle are aligned end to end.

FIG. 1 illustrates one embodiment a knife of the present invention. A camp knife 100 provides one embodiment of the invention illustrated. The camp knife 100 is a tri-fold knife and has a blade 102 with a cutting edge 103. The blade 102 terminates in a tang 104. The camp knife 100 has a main handle 106 having a forward end 108 and a butt end 110. A main handle bearing surface 112 (best shown in FIG. 4) has a width W. The main handle 106 has a main handle slot 114 having main handle slot sides 116 initiating at the main handle bearing surface 112 and terminating in a main handle slot back 118. The main handle slot 114 traverses the length of the main handle 106 and extends through the forward end 108 and the butt end 110. The tang 104 is mounted in the main handle slot 114 (best shown in FIG. 3) and is pivotably attached to the forward end 108.

The camp knife 100 is provided with a tail handle 120 which has a forward engaging end 122 and a butt end coupling 124. The butt end coupling 124 is pivotably connected to the butt end 110 of the main handle 106. A tail handle bearing surface 126 also has the width W. The tail handle 120 has a tail handle slot 128 (best seen in FIG. 4). The tail handle slot 128 has tail handle slot sides 130 initiating at the tail handle bearing surface 126 and terminating at a tail handle slot back 132. The tail handle slot 128 passes through the forward engaging end 122 and the butt end coupling 124. The tail handle slot 128 joins the main handle slot 114 forming a continuous slot. A butt stop 134 is provided which limits the rotation of the main handle 106 with respect to the tail handle 120 so that when the tail handle 120 is in the open position, as illustrated in FIG. 1, the tail handle slot 128 forms a smooth continuation of the main handle slot 114 providing a sheath for the cutting edge 103 of the blade 102.

While the cross section of the abutting surfaces has been illustrated as rectangular, it should be appreciated that other geometries are possible and that W can vary along the length of the handle to provide a contoured handle. Similarly, while the abutting surfaces are illustrated as being planar, it should be appreciated that the surfaces can be curved and when the curved surfaces abut, the surfaces themselves can provide locking means to assure that the handle components will not translate relative to each other in the closed position.

Figure 2:
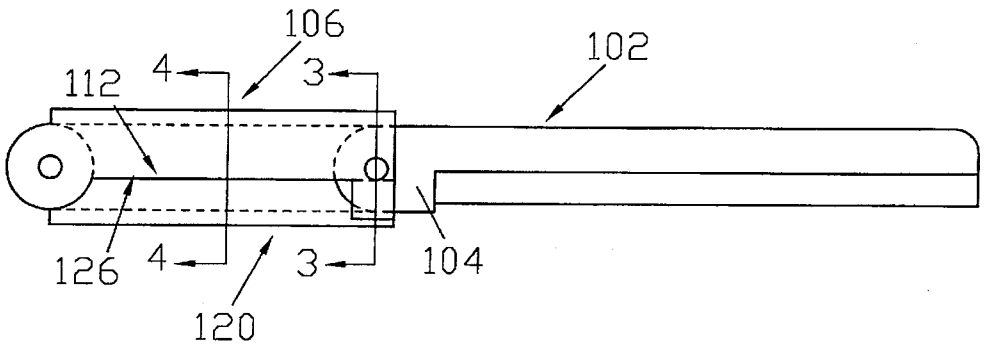
FIG. 2 is the tri-fold camp knife of FIG. 1 where the tail handle has been rotated into a side by side relationship with the main handle and is in contact with the main handle. The tail handle and the main handle abut and form a grip for the knife blade.

FIG. 2 illustrates the camp knife 100 of FIG. 1 where the tail handle 120 has been rotated into contact with the main handle 106 bringing the main handle bearing surface 112 in contact with the tail handle bearing surface 126. The blade 102 is held firmly in place by engagement of the tang 104 with the forward end 108 of the main handle 106 and the forward engaging end 122 of the tail handle 120.

Figure 3:
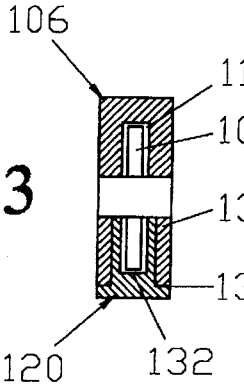
FIG. 3 is a view of a cross section 3—3 of the camp knife of FIG. 2.

FIG. 3 illustrates a cross section 3—3 of FIG. 2 and shows the main handle slot back 118 and the tail handle slot back 132. The main handle slot back 118 and the tail handle slot back 132 engage the tang 104 of the blade 102 when the bearing surfaces (112, 126) are engaged and the main handle 106 and the tail handle 120 form a grip for the camp knife 100.

Figure 4:
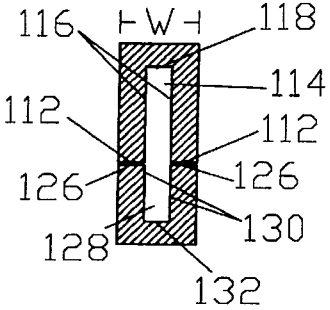
FIG. 4 is a view of a cross section 4—4 of the camp knife of FIG. 2.

FIG. 4 illustrates that the tail handle bearing surface 126 and the main handle bearing surface 112 have the same width W and thus, when closed, they abut providing both support and a smooth transition between the main handle 106 and the tail handle 120. The main handle 106 of the camp knife 100 can be substantially solid as is shown in FIG. 4 and thus, will have the rigidity approximately of a conventional solid handle. Additional rigidity for the handle in the closed position is obtained by providing main handle lugs 135 which engage lug recesses 136. Since the lugs 135 are on a plane substantially normal to the bearing surfaces (112, 126), the tail handle 120 and the main handle 106 are rigidly supported in orthogonal planes providing a rigid grip.

Figure 5:
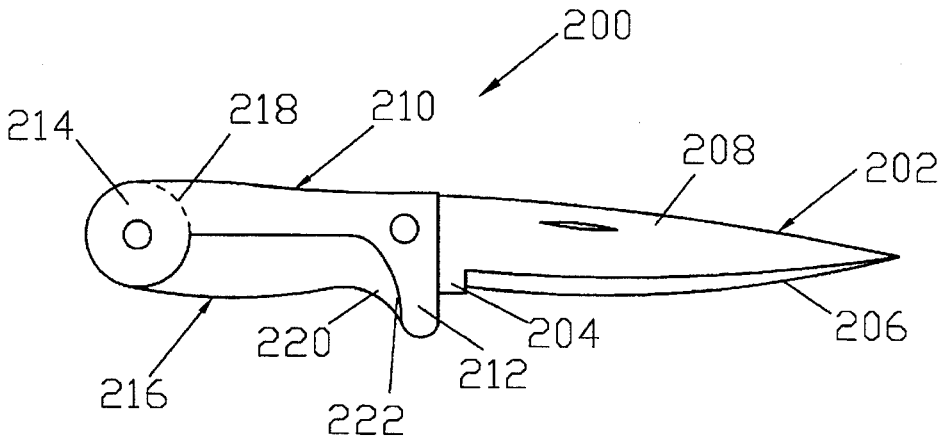
FIG. 5 is another embodiment of the invention for a tri-fold hunting knife. The knife has a guard not provided for in the camp knife.

FIG. 5 illustrates a second embodiment of the invention for a hunting knife 200. The hunting knife 200 has a blade 202 with a tang 204. The blade has a cutting edge 206 and a back edge 208. The cutting edge 206 is contoured to provide a cutting edge which is convex when viewed from the back edge 208.

The hunting knife 200 has a main handle 210 having a forward end 212 and a butt end 214. A tail handle 216 is provided which has a butt end coupling 218 which is pivotably attached to the butt end 214. The tail handle 216 has a forward engaging end 220.

With the cutting edge 206 being convex, it can readily be sheathed by the tail handle 216 which has a forward engaging end region 222 contoured to provide a guard for the blade 202 to avoid the hand of the user accidentally sliding onto the blade 202.

Figure 6:
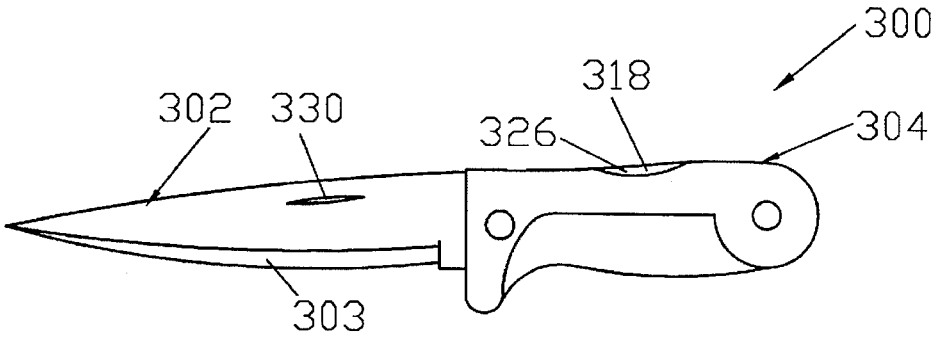
FIG. 6 is a tri-fold knife of the present invention which has a locking mechanism to lock the knife in both the open and the closed position. The knife is shown in the open position in FIG. 6.
Figure 7:
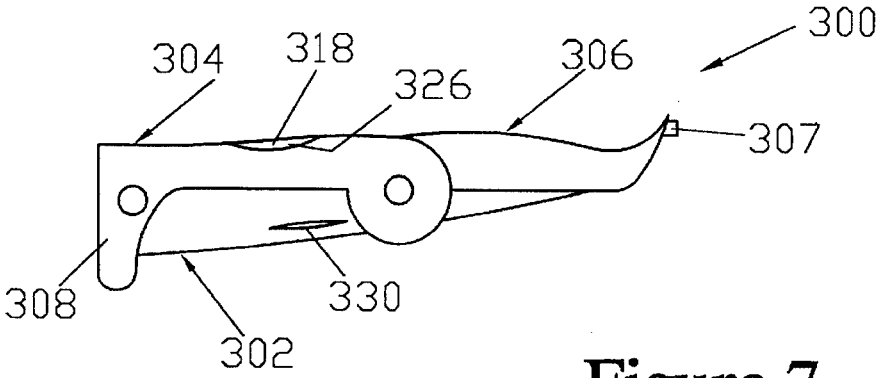
FIG. 7 is the tri-fold knife of FIG. 6 shown with the blade in the closed position where the main handle and the tail handle serve as a sheath for the cutting edge of the blade.
Figure 8:
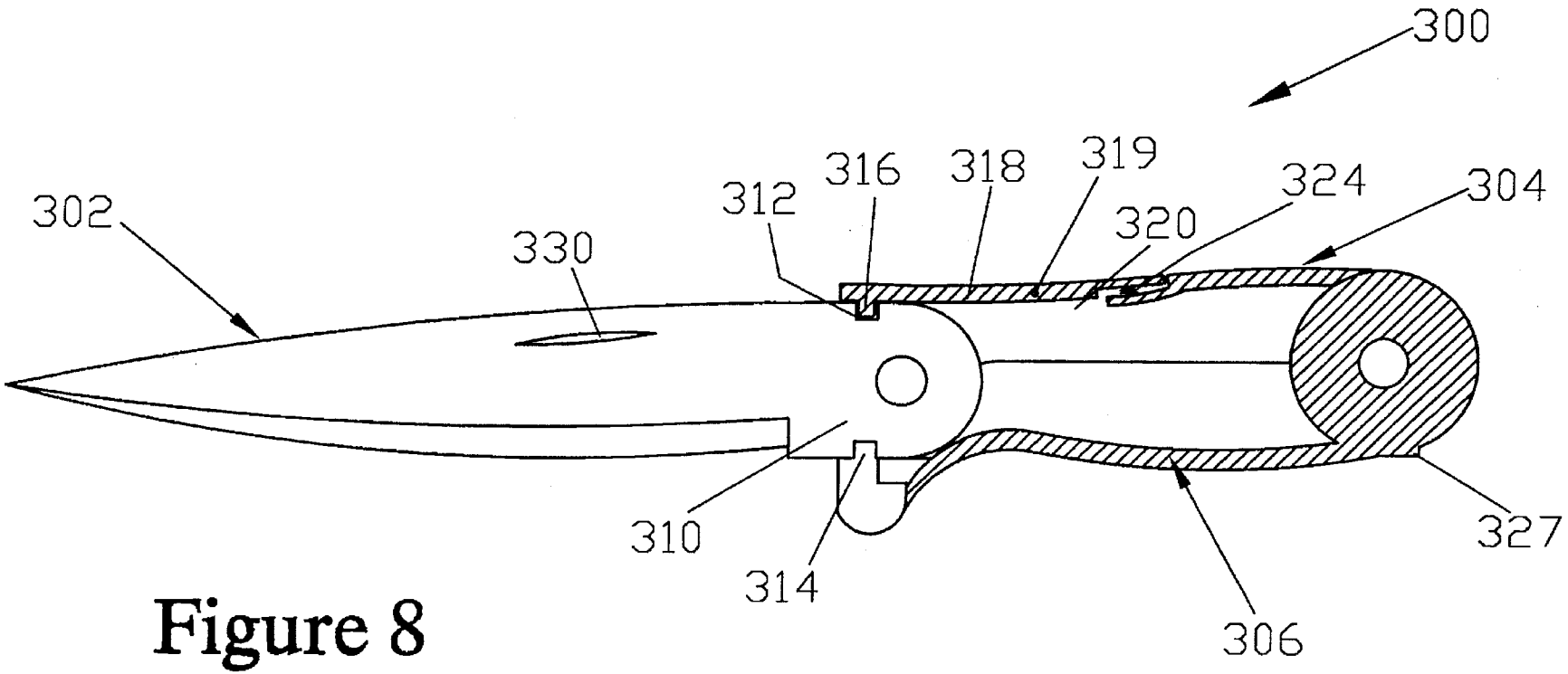
FIG. 8 is a sectional view of FIG. 6 illustrating the locking mechanism.

FIGS. 6 through 8 show another embodiment of the present invention. In this embodiment, a hunting knife 300 is provided with a locking means to avoid accidental opening and closing of the blade with respect to the handle. Referring first to FIG. 6, the hunting knife 300 has a blade 302 having a cutting edge 303. The blade 302 is pivotably engaged with a main handle 304. The main handle 304, in turn, is pivotably engaged with a tail handle 306. The hunting knife 300, as illustrated in FIG. 6, has the blade 302 extended and embraced by both the main handle 304 and the tail handle 306 which are engaged and serve as a handle for the hunting knife 300.

FIG. 7 illustrates the same hunting knife 300, wherein the main handle 304 and the tail handle 306 are pivoted so that the handle segments (304 and 306) will sheath the cutting edge 303 of the blade 302. A lug 307 is provided to engage a forward end 308 of the main handle 304 to further stabilize the relative position of the main handle 304 when engaged with the tail handle 306.

FIG. 8 is a sectional view of the hunting knife 300 of FIG. 6, illustrating the interconnection of the blade 302 with the main handle 304 and the tail handle 306. In this embodiment, the blade 302 has a tang 310 which is provided with an open position notch 312 and a closed position notch 314. When the blade 302 is extended, as illustrated in FIG. 8, the open position notch 312 is engaged by a locking lug 316 which in turn is connected to a locking bar 318. The locking bar 318 is pivotably mounted on a pin 319 which is supported by the main handle 304. The locking bar 318 forms the back side of a main handle slot 320 into which the cutting edge 303 of the blade 302 is sheathed when the hunting knife 300 is in the closed position as is shown in FIG. 7.

The locking lug 316 is maintained in the open position notch 312 by the pressure exerted by a spring 324 which applies torque to the locking bar 318. To disengage the locking lug 316, the locking bar 318 is depressed in a recessed region 326 of the main handle 304 where there is a depression, as is illustrated in FIGS. 6 and 7. This recessed region 326 allows pressure to be applied to the locking bar 318.

The locking bar 318 and locking lug 316 used in this invention are known in the art and are used in a variety of standard knives. A number of standard knives have opening locks such as taught in U.S. Pat. No. 4,563,813.

When the knife blade 302 is in the closed position, as shown in FIG. 7, the locking lug 316 will engage the closed position notch 314 and lock the blade 302 in the closed position. When the blade 302 is so locked, the sheath comprising the main handle 304 and the tail handle 306 will engage the knife blade 302.

The blade 302 will be maintained in the sheath since it is locked with respect to the main handle 304 and the tail handle 306. The tail handle 306 is provided with a butt stop 327 which avoids rotation of the tail handle 306 beyond the position illustrated in FIG. 7, thereby affixing the tail handle 306 with respect to the blade 302.

To release the blade 302 from the closed position, the locking bar 318 is pressed. The recessed region 326 of the main handle 304 allows the user to press on the locking bar 318 lifting the locking lug 316, thereby allowing the blade 302 to rotate. A nail groove 330 is provided to assist in gripping the blade 302 when rotating the blade 302 away from the main handle 304 and the tail handle 306. Thereafter, the tail handle 306 can be rotated to bring it in contact with the main handle 304 into the position shown in FIG. 6 so that the main handle 304 and tail handle 306 will be positioned to form a grip for a conventional hunting type knife with the blade 302 extending from the handle.

Figure 9:
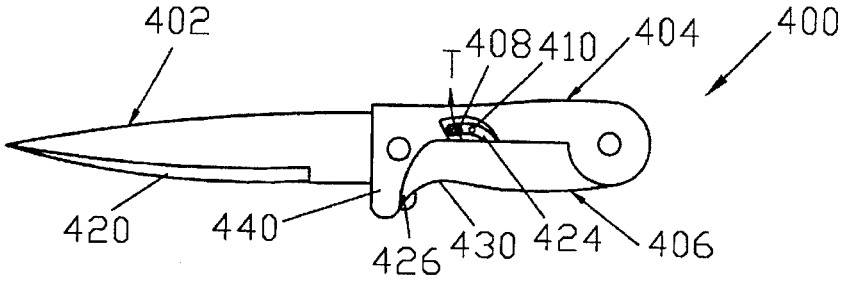
FIG. 9 is a variation of the tri-fold knife of FIG. 6 which has been modified so that it can readily be opened with one hand. The knife, as illustrated, is in the open position and serves as a hunting knife.
Figure 10:
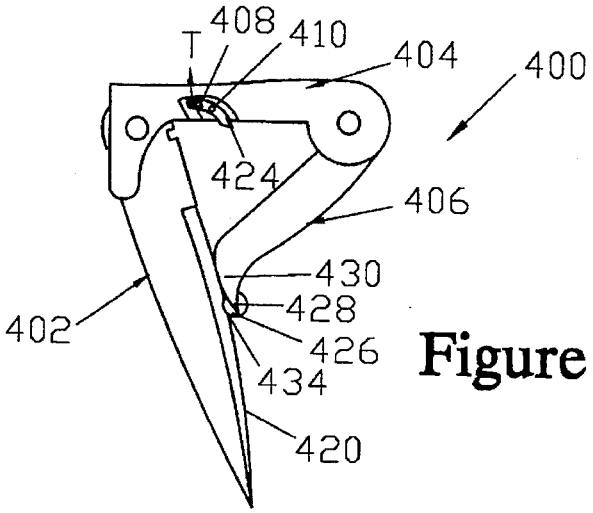
FIG. 10 is the tri-fold knife of FIG. 9 where the knife is in the process of being opened or closed.

FIGS. 9 and 10 illustrate another embodiment of the present invention. In this embodiment a knife 400, similar to the knife shown in FIGS. 6 through 8, is shown but the knife 400 differs in that a lever mechanism has been added to further assist in opening and closing the blade with respect to the handle.

The knife 400 has a blade 402 and a main handle 404. The blade 402 is pivotably attached to the main handle 404 and the main handle 404, in turn, is pivotably attached to a tail handle 406. FIG. 10 illustrates the blade 402 being rotated away from its aligned position with the main handle 404. Similarly, the tail handle 406 has been rotated away from the main handle 404.

Levers 408 are attached to a shaft 410 that passes through the main handle 404 and are positioned on both sides of the main handle 404. It should be appreciated that a single lever could be used.

Figure 11:
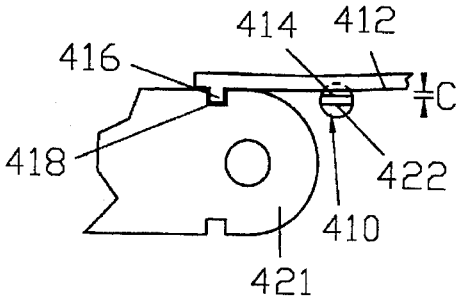
FIG. 11 is a detailed section of the locking mechanism of the knife of FIGS. 9 and 10 with the locking mechanism locking the knife in the open position.
Figure 12:
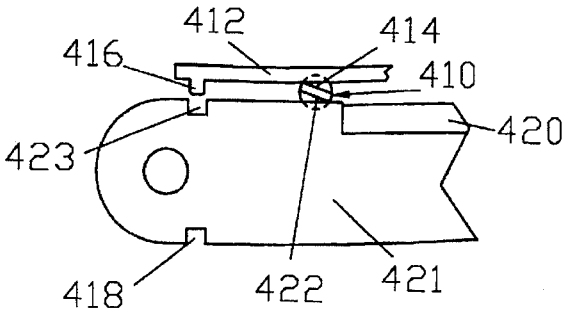
FIG. 12 is a detailed section of the locking mechanism of the knife of FIGS. 9 and 10 with the locking mechanism locking the knife in the closed position.

The shaft 410 is further illustrated in FIGS. 11 and 12. The shaft 410 is positioned in close proximity to a locking bar 412. The shaft 410 is ground to provide a clearance c between itself and the locking bar 412, creating a locking bar raising surface 414, as illustrated in FIG. 11. When the levers 408 are urged upward, as illustrated by the arrow T in FIGS. 9 and 10, the shaft 410 rotates clockwise causing the locking bar raising surface 414 to rotate against the locking bar 412, lifting it upward and disengaging a locking lug 416 from an open position notch 418 as is shown in FIG. 11. Unlocking the blade 402 allows it to swing toward the main handle 404. When the blade 402 is closed so that a cutting edge 420 is sheathed by the main handle 404 and the tail handle 406, in order for the shaft 410 not to interfere with the tang 421 of the blade 402, a tang raising surface 422 is provided.

When the blade 402 is in the closed position, as is illustrated in FIG. 12, and the levers 408 are turned as illustrated in FIGS. 9 and 10, the locking bar raising surface 414 will raise the locking bar 412. Once the locking bar 412 has been raised sufficiently to remove the locking lug 416 from the closed position notch 423, the tang raising surface 422 engages the tang 421, rotating the blade 402 away from the main handle 404 and initiating the opening of the blade 402 from the closed position. When the lever mechanism illustrated in the present embodiment is employed, it alleviates the need for a nail groove as is shown in FIGS. 6 through 8.

In order to assist the opening of the handle segments (404 and 406), when closing the knife 400, lever legs 424 are provided. The lever legs 424 are coupled to the levers 408 and are positioned to engage the tail handle 406 when it abuts the main handle 404. Again, when the levers 408 are rotated, as is shown in FIGS. 9 and 10, the lever legs 424 will urge the tail handle 406 away from the main handle 404, thus assisting in closing the blade 402.

In fact, the knife 400, as illustrated in FIGS. 9 and 10, is one which can be operated with a single hand, the knife being held in the palm and the thumb and or index finger being used to manipulate one or both of the levers 408. To further assist the opening and closing of the blade 402, a guide wheel 426 is provided. The guide wheel 426 is mounted on a guide wheel shaft 428 which passes through a forward engaging end 430 of the tail handle 406. The guide wheel 426 rides on the cutting edge 420 of the knife blade 402, thereby urging the knife blade 402 open as the handle segments (404 and 406) are collapsed to the closed position.

It is further preferred that the guide wheel 426 have a groove 434 therein. The material for the wheel is chosen such that surface of the groove 434 serves as a lapping surface so that the cutting edge 420 is sharpened by the process of opening and closing the knife 400. The guide wheel 426 also serves as a lug which engages a forward end 440 (see FIG. 9) of the main handle 404.

Figure 13:
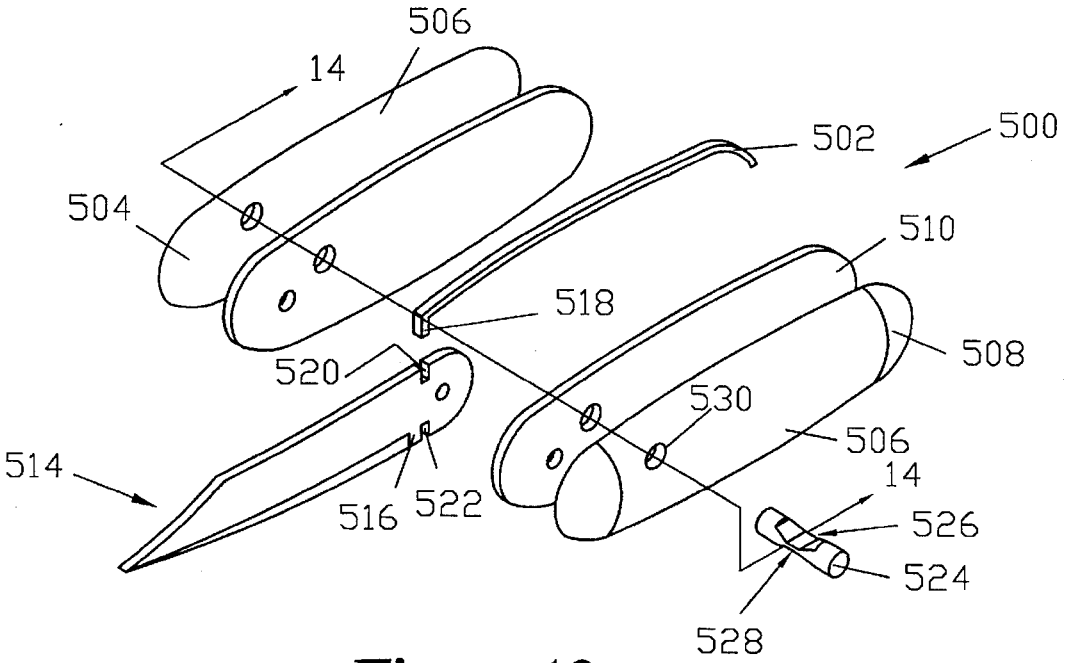
FIG. 13 is a pocket knife having one embodiment of the release mechanism of the present invention which is suitable for use in bi-fold and tri-fold knives. In this embodiment, buttons are provided to operate the release mechanism.

An alternative to the lever mechanism employed in the embodiment illustrated in FIGS. 9 through 12 to release the locking bar 412 is a button operated system. Furthermore, both the lever mechanisms and button mechanisms are useable with conventional pocket knives employing a locking bar mechanism and are not restricted to tri-fold knives. FIG. 13 is an exploded view of a bi-fold pocket knife 500 which employs a conventional locking bar 502. The bi-fold pocket knife 500 has forward ends 504, handles 506, and butt ends 508. Linings 510 are positioned between the handles 506. The linings 510 are spaced apart so as to accommodate a blade 514 having a tang 516. The locking bar 502 is provided with a locking lug 518 which engages an open position notch 520 when the blade 514 is in the open position. When the locking lug 518 engages the open position notch 520, the blade 514 is locked in the open position. A closed position notch 522 is also provided in the tang 516 which locks the blade 514 in the closed position when the locking lug 518 engages the closed position notch 522. A mechanism must be provided which will raise the locking lug 518 so that the blade 514 may be swung from a closed position to an open position. The present embodiment employs a rod 524 configured to provide a locking bar raising surface for raising the locking bar 502. The rod 524 has a first region of reduced cross section 526 into which the locking bar 502 projects. When it is desired to also employ the rod 524 to urge the blade 514 out of its closed position, a second region of reduced cross section 528 is provided. The tang 516 of the blade 514 projects into the second region of reduced cross section 528. The rod 524 slidably engages a passage 530 in the bi-fold pocket knife 500.

Figure 14:
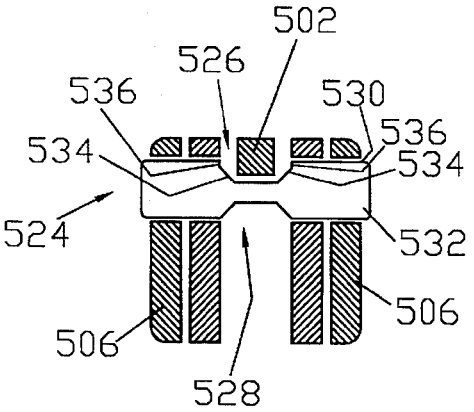
FIG. 14 is a cross section 14—14 of FIG. 13.

FIG. 14 illustrates a cross section 14—14 of FIG. 13 where the parts are shown in their assembled position. The rod 524 slidably engages the passage 530 and, when so positioned, provides buttons 532 which protrude from the handles 506. The buttons 532 can be pressed by the users thumb or forefinger to slide the rod 524 in the passage 530. The first region of reduced cross section 526 into which the locking bar 502 protrudes has first sloped sidewalls 534. When one of the buttons 532 is pressed, one of the first sloped sidewalls 534 slidably engages the locking bar 502, lifting the locking bar 502 so as to free the locking lug 518 from the open position notch 520. The first sloped sidewalls 534 preferably terminate in vertical sections 536 which limit the motion of the rod 524 and provide stops when the vertical sections 536 impact the locking bar 502.

Figure 15:
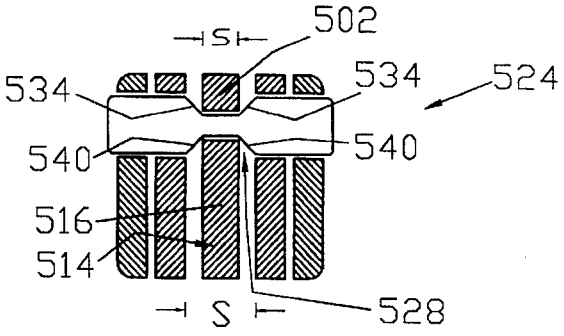
FIG. 15 is the same cross section as FIG. 14 with the blade being in the closed position.

FIG. 15 illustrates the same cross section of the bi-fold pocket knife 500; however, it differs from the cross section illustrated in FIG. 14 since the blade 514 is in the closed position. When the blade 514 is so positioned, the tang 516 projects into the second region of reduced cross section 528 of the rod 524. The second region of reduced cross section 528 has second sloped sidewalls 540 which are configured to urge the blade 514 from the closed position. This is accomplished by having the second sloped sidewalls 540 so contoured and positioned to engage the tang 516 after the first sloped sidewalls 534 have engaged the locking bar 502 and raised it sufficiently for the locking lug 518 to have disengaged from the closed position notch 522. Thus, the separation s of the first sloped sidewalls 534 is less than the separation S of the second sloped sidewalls 540.

Figure 16:
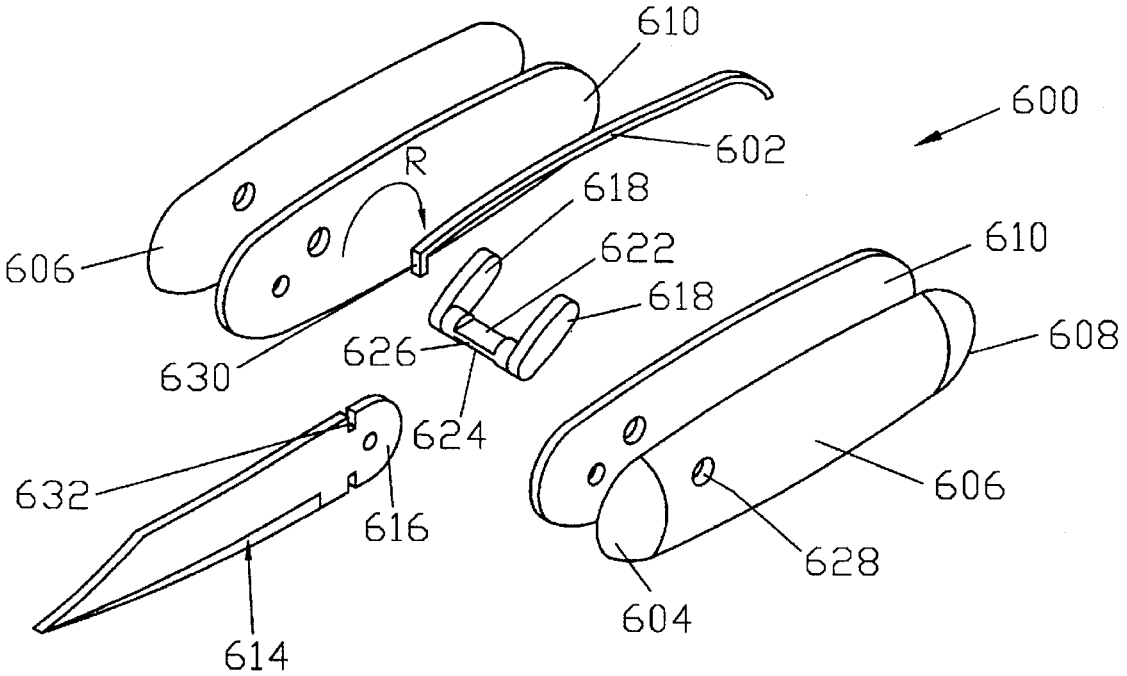
FIG. 16 is a pocket knife having one embodiment of the release mechanism of the present invention which is suitable for use in bi-fold and tri-fold knives. In this embodiment, levers are provided to operate the release mechanism.

FIG. 16 illustrates an alternative embodiment for the sloped walled rod employed in the embodiment illustrated in FIGS. 13 through 15.

FIG. 16 is an exploded view of another bi-fold pocket knife 600. The bi-fold pocket knife 600 employs a conventional locking bar 602. Again, the bi-fold pocket knife 600 has forward ends 604, handles 606, and rear ends 608. Linings 610 are positioned between the handles 606. The linings 610 are spaced apart so as to accommodate a blade 614 having a tang 616.

In this embodiment, levers 618 are employed to provide mechanical advantage in turning a rod 620 which raises the locking bar 602 and engages the tang 616. The rod 620 is positioned between the levers 618. The rod 620 has a first region of reduced cross section 622 and a second region of reduced cross section 624. A connecting bar 626 is left between the two regions (622, 624). The rod 620 rotatably engages a passage 628 of the bi-fold pocket knife 600.

Figure 17:
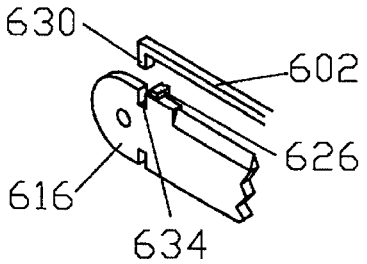
FIG. 17 illustrates the mechanism for releasing the locking mechanism when the blade of the knife is locked in the open position.
Figure 18:
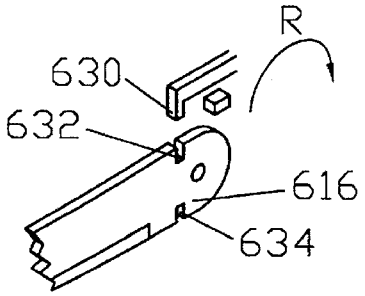
FIG. 18 illustrates the mechanism for releasing the locking mechanism when the blade of the knife is locked in the closed position.

The levers 618, when rotated as illustrated by the arrow R, bring the connecting bar 626 into contact with the locking bar 602, as is illustrated in FIG. 17, rotating the locking bar 602 and raising a locking lug 630 from an open position notch 632.

When the blade 614 is closed between the linings 610, the locking lug 630 engages a closed position notch 634. In order to open the blade 614, the locking lug 630 must be removed from the closed position notch 634. The locking lug 630 can be raised again, by rotating the levers 618 in the direction R to lift the locking bar 602 and raise the locking lug 630 from the closed position notch 634. If the levers 618 are further rotated in the direction R, the connecting bar 626 will contact the tang 616 and lift the blade 614 out of the handles 606.

Again, it is important that the separation between the connecting bar 626, the locking bar 602 and the tang 616 be maintained such that the connecting bar 626 raises the locking bar 602 to remove the locking lug 630 from closed position notch 634 prior to the connecting bar 626 engaging the tang 616.

What I claim is:

1. tri-fold knife comprising:

a blade having a tang and a cutting edge;

a main handle terminating in a forward end and butt end, said main handle having a main handle bearing surface having a width W and a main handle slot disposed in said main handle bearing surface and having main handle slot sides initiating at said main handle bearing surface and terminating in a main handle slot back, said main handle slot extending from said forward end through said butt end, and said tang residing in said main handle slot and being pivotably mounted in said forward end;

a tail handle terminating in a forward engaging end and a butt end coupling which pivotably engages said butt end of the main handle, said tail handle having a tail handle bearing surface having said width W, and a tail handle slot disposed in said tail handle bearing surface and having tail handle slot sides initiating at said tail handle bearing surface and terminating in a tail handle slot back, said tail handle slot extending from said forward engaging end through said butt end coupling and connecting with said main handle slot, said tail handle rotating from a closed position where said tail handle bearing surface abuts said main handle bearing surface to an open position where said main handle and said tail handle are substantially collinear; and a butt stop, which is attached to one of said butt end of said main handle and said butt end coupling of said tail handle, limiting the pivotal motion between said main handle and said tail handle when in said open position such that when said pivotal motion is limited in said open position, said main handle slot back and said tail handle slot back are substantially co-planar at their junction such that said cutting edge will engage said main handle slot and said tail handle slot when said blade is pivoted into said main handle slot and said tail handle slot.

2. The tri-fold knife of claim 1 further comprising means for locking said forward end to said forward engaging end.

3. The tri-fold knife of claim 2 wherein said main handle slot sides and said tail handle slot sides are in close proximity to said blade when said blade is pivoted into said main handle slot and said tail handle slot.

4. The tri-fold knife of claim 2 wherein said means for locking said forward end to said forward engaging end further comprises:

lugs on said forward end and lug recesses in said forward engaging end of said tail handle.

5. The tri-fold knife of claim 4 wherein said forward engaging end is contoured to form a guard portion which, in combination with said forward end, forms a guard to prevent the hand of the user from accidentally sliding onto the blade when said blade is pivoted away from said main handle slot and said tail handle slot, and said tail handle is pivoted to bring said forward end and said forward engaging end into contact.

6. The tri-fold knife of claim 5 wherein said tang has an open position notch and a closed position notch and the tri-fold knife further comprises:

a locking bar pivotably mounted in said main handle slot;

a spring interposed between said locking bar and said main handle for positioning said locking bar;

a locking lug attached to said locking bar, said locking lug, said open position notch, and said closed position notch being so positioned such that when said locking lug engages said closed position notch said cutting edge of said blade is positioned in said main handle slot and said tail handle slot and when said locking lug engages said open position notch said blade is positioned in an end to end relationship to said main handle; and means to raise said locking bar to disengage said locking lug from said open position notch and said closed position notch.

7. The tri-fold knife of claim 6 further comprising:

means for urging said blade to open.

8. The tri-fold knife of claim 7 wherein said means to raise said locking lug further comprises:

a locking bar raising surface for raising said locking bar, said locking bar raising surface slidably engaging said locking bar; and further wherein said means for urging said blade to open further comprises:

a tang raising surface for urging said blade open, said tang raising surface slidably engaging said tang of said blade.

9. The tri-fold knife of claim 8 further comprising:

a rod passing through said main handle including said locking bar raising surface and said tang raising surface; said rod having, a first region of reduced cross section into which said locking bar projects, said first region of reduced section having first sloped side walls which serve as said locking bar raising surface and engage said locking bar, and a second region of reduced cross section into which said tang projects, said second region of reduced section having second sloped side walls which serve as said tang raising surface and engage said tang.

10. The tri-fold knife of claim 8 further comprising:

a rod passing through said main handle and including said locking bar raising surface and said tang raising surface; said rod having, a first pivoting surface providing said locking bar raising surface, and a second pivoting surface which serves as said tang raising surface; and a lever attached to said rod which pivots said first pivoting surface and said second pivoting surface.

11. The tri-fold knife of claim 10 further comprising:

a lever leg coupled to said lever and positioned to engage said tail handle when said tail handle bearing surface abuts said main handle bearing surface.

12. The tri-fold knife of claim 11 further comprising:

a guide wheel shaft which passes through said forward engaging end; and a guide wheel having a groove therein, said guide wheel being mounted on said guide wheel shaft, said shaft being positioned such that said cutting edge of said blade rides in said groove when said main handle and said tail handle are collapsed from said open position to said closed position as said blade is rotated from a position where it resides in said main handle slot and said tail handle slot.

13. The tri-fold knife of claim 12 wherein said wheel is a sharpening stone.

* * * * *